US007132912B2

(12) United States Patent
Busenhart

(10) Patent No.: US 7,132,912 B2
(45) Date of Patent: Nov. 7, 2006

(54) MOVING CONTACT UNIT FOR A CONTACT ARRANGEMENT IN A CIRCUIT BREAKER

(75) Inventor: Thomas Busenhart, Schaffhausen (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 11/152,256

(22) Filed: Jun. 15, 2005

(65) Prior Publication Data

US 2006/0001511 A1 Jan. 5, 2006

(30) Foreign Application Priority Data

Jul. 5, 2004 (EP) ..... 04405415

(51) Int. Cl.
*H01H 9/20* (2006.01)

(52) U.S. Cl. ..... 335/6; 335/10; 335/21; 335/22; 335/167; 335/171

(58) Field of Classification Search ..... 335/165–176, 335/6, 8–10, 21–25
See application file for complete search history.

(56) References Cited

U.S. PATENT DOCUMENTS

| | | | | |
|---|---|---|---|---|
| 2,370,206 A | | 2/1945 | Taylor | |
| 4,595,895 A | * | 6/1986 | Fujii et al. | 335/26 |
| 4,618,745 A | | 10/1986 | Thompson, III | |
| 4,641,001 A | * | 2/1987 | Fujihisa et al. | 200/401 |
| 5,214,402 A | * | 5/1993 | DiVincenzo et al. | 335/167 |
| 5,539,167 A | * | 7/1996 | Hood et al. | 200/244 |
| 6,492,607 B1 | | 12/2002 | Bruckert et al. | |

FOREIGN PATENT DOCUMENTS

| | | | |
|---|---|---|---|
| EP | 0577586 | * | 6/1992 |
| EP | 0 570 647 A1 | | 11/1993 |
| EP | 0570647 | * | 11/1993 |
| EP | 0 616 350 A1 | | 9/1994 |
| EP | 0 696 041 A1 | | 2/1996 |
| WO | 02/052597 A1 | | 7/2002 |

* cited by examiner

*Primary Examiner*—Ramon M. Barrera
(74) *Attorney, Agent, or Firm*—Buchanan Ingersoll & Rooney PC

(57) ABSTRACT

The moving contact unit (10) is intended for a contact arrangement in a circuit breaker and contains a contact mount (13) and a contact piece (11, 111, 112), which is held by the contact mount (13). The contact mount (13) is arranged on a pivoting shaft (12), which can be mounted in the switch, and is fitted with a catch (135) which can pivot, and with a tripping lever (14) which can pivot and, together with the catch (135), forms a latching point.

A simple configuration for the contact unit and for the contact arrangement which holds this contact unit is made possible, despite stringent requirements for maintenance of the circuit breaker and despite a high disconnection rating in that the tripping lever (14) is also arranged on the pivoting shaft (12) alongside the contact mount (13), and in that the contact piece (11) is placed on the contact mount (13) and is held by at least one prestressed bending spring (51), which is mounted on the pivoting shaft (12).

11 Claims, 3 Drawing Sheets

Fig.3
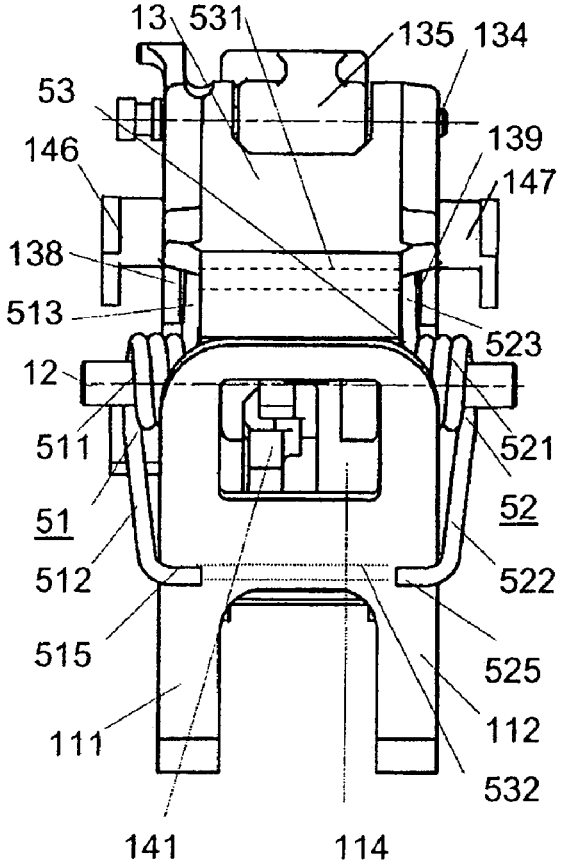
Fig.4
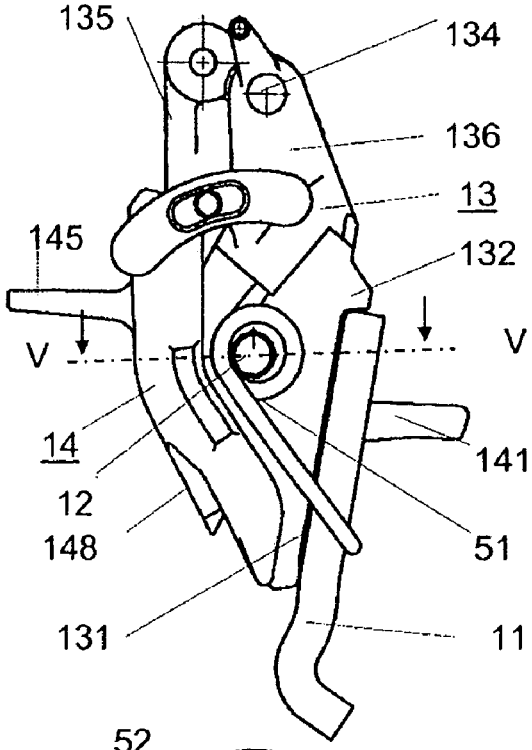
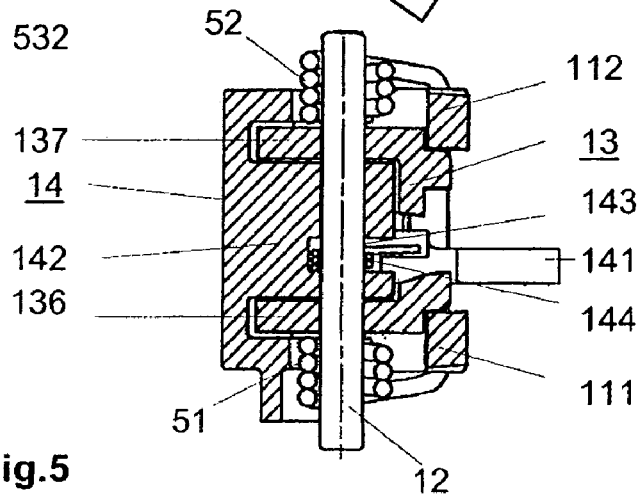
Fig.5

MOVING CONTACT UNIT FOR A CONTACT ARRANGEMENT IN A CIRCUIT BREAKER

TECHNICAL FIELD

The present invention relates to the field of circuit breakers for low-voltage distribution networks. It relates in particular to a moving contact unit for a contact arrangement in a circuit breaker as claimed in the precharacterizing clause of patent claim 1, and to a contact arrangement having such a contact unit, and to a circuit breaker having this contact arrangement.

Circuit breakers in the form of flush-mounted service switches are used in low-voltage distribution networks for quick and reliable protection of cables, motors, apparatuses and systems to which low voltage is applied against the consequences of overloading and short-circuit currents. Generally, they each have a thermal release with a bimetallic strip, and an electromagnetic release with a coil and an impact-type armature, as well as a contact arrangement which interacts with a quenching device and in general has one or two switching points. Depending on whether it has one or two switching points, the contact arrangement contains one or two stationary contact pieces as well as a moving contact unit which interacts with it/them and has one contact piece or has two contact pieces, which are generally integrated in a contact link.

PRIOR ART

A moving contact unit of the type mentioned above is described in EP 0 616 350 A1. The described contact unit is part of a contact arrangement of a circuit breaker, and contains an extended contact mount, one of whose ends is mounted such that it can pivot on a stationary shaft that is held in the housing of the circuit breaker, and whose other end is in the form of a contact piece and, when the circuit breaker is in the connected state, is supported on a stationary contact piece of the contact arrangement. The contact mount holds a latching lever, which is mounted on the stationary shaft such that it can pivot, as well as a two-armed lever, whose rotation point is arranged approximately in the center of the contact mount. One arm (which is provided with a striking surface) of the two-armed lever interacts with a tripping pin of a thermal and magnetic release while, in contrast, the other arm is fitted with a latching hook. The latching hook and the latching lever form a latching point (which is generally referred to as a breaker latching mechanism) in the circuit breaker. The breaker latching mechanism is closed during connection of the circuit breaker by tilting a switching lever (which is coupled with a force fit via a transmission bracket to the latching lever) while at the same time loading a spring energy store to a preferred position. When a short-circuit current or overcurrent occurs, the release trips and opens the breaker latching mechanism, via the tripping pin. The spring energy store, which has not been unloaded, rotates the moving contact unit about the stationary shaft, and opens the contact arrangement in the circuit breaker.

DESCRIPTION OF THE INVENTION

The invention, as it is specified in the patent claims, is based on the object of providing a moving contact unit of the type mentioned initially, a contact arrangement having such a moving contact unit, and a circuit breaker with this contact arrangement, which allow a high disconnection rating, with a simple configuration and minor maintenance requirements.

In the moving contact unit according to the invention, a tripping lever is also arranged on the pivoting shaft alongside a contact mount, and a contact piece is placed on the contact mount and is held by at least one prestressed bending spring, which is mounted on the pivoting shaft. These measures allow the contact unit to be fitted easily by plugging the contact mount, the tripping lever and a tripping spring onto the pivoting shaft, and by then fixing these components and the contact piece by means of a bending spring, or possibly two bending springs. In this case, it is particularly advantageous that the bending spring not only fixes the various components of the moving contact part, but at the same time also defines the contact force of the contact piece which rests only on the contact mount. Since the contact piece rests on the contact mount, it can easily be replaced and exchanged for a contact piece which may have different dimensions.

Quick fitting or removal of the moving contact unit according to the invention and simple control of the contact force are made possible by means of a bending spring which has a cylindrical helical spring through which the pivoting shaft passes and which has two limbs which can rotate in opposite directions with respect to one another, one of which limbs is supported on the contact mount, and the other is supported on the contact piece, forming the prestress. A bending spring such as this can easily be plugged onto the pivoting shaft and can be fixed easily by bending up the two lever arms in a simple manner, fixing the contact mount, the contact piece, the pivoting shaft and the tripping lever. The formation of a holding finger, which clasps the contact piece, in the limb which is supported on the moving contact piece holds the contact piece by simple means while, in contrast, the second limb is advantageously held in a groove which is formed in the contact mount.

A particularly robust moveable contact unit is achieved by providing two bending springs which are arranged with mirror-image symmetry on the shaft, or by the bending spring being in the form of a double-torsion spring and having the following components:

two cylindrical helical springs, through each of which the pivoting shaft passes, a U-shaped connection section which couples the two helical springs with a force fit and is supported on the contact mount, and two limbs which are respectively connected to in each case one of the two helical springs and are supported on the contact piece, forming the prestress.

In the double-torsion spring, the two helical springs are coupled to one another with a force fit by means of the U-shaped connection section, thus fixing the spring axially. There is therefore no need for any groove on the contact mount to hold one of the limbs of the bending spring.

For reasons relating to a high current carrying capacity and simple manufacture, the contact mount is made from insulating material and holds a contact link, which is fitted with two contact pieces, instead of one contact piece.

A contact force which is defined by the characteristic of the bending spring and acts over a long distance is formed by designing the contact link as follows:

it is U-shaped, the two contact pieces form the limbs of the U, the base of the U is in the form of a plate, rests on one surface of the contact mount and, on its side which faces away from the contact pieces, rests on a projection which is formed in the contact mount.

Specifically, when the contact arrangement is being closed, the two contact pieces of the contact link then strike against two stationary contact pieces of the contact arrangement and are then pivoted about a shaft, which is formed by the projection, against the influence of the bending spring. In the process, a defined contact force is produced over a comparatively long distance. This allows unavoidable contact erosion to be compensated for well.

The contact link is held particularly well by the base of the U, which is in the form of a plate, having an opening into which a tab which is integrally formed in the contact mount projects. An arm which is formed in the tripping lever can also be passed through this opening and can be operated by a tripping element of a preferably thermal or magnetic tripping unit.

BRIEF DESCRIPTION OF THE FIGURES

One exemplary embodiment of the invention will be explained in more detail in the following text with reference to drawings, in which:

FIG. 3 shows a view of the contact unit as shown in FIG. 2, transversely with respect to the pivoting shaft, FIG. 4 shows a view of the contact unit as shown in FIG. 2, in the direction of the pivoting shaft, and FIG. 5 shows a plan view in the direction of the arrow of a section along the line V—V through the contact unit as shown in FIG. 4.

APPROACHES TO IMPLEMENTATION OF THE INVENTION

Figure 1:
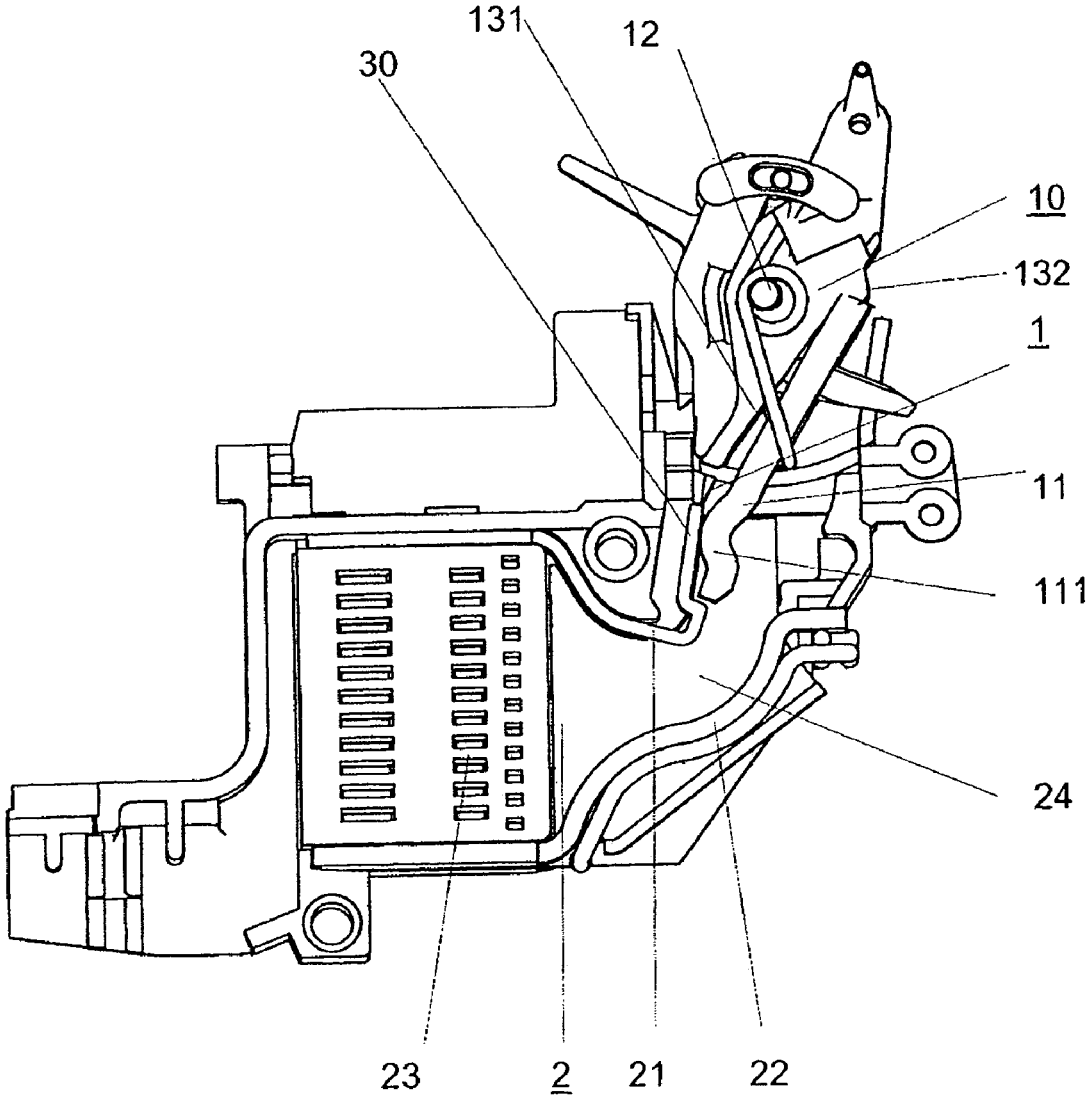
FIG. 1 shows a view in the direction of a pivoting shaft of a part of a circuit breaker in the connected state with a contact device (which contains a moving contact unit according to the invention) and with an arc quenching device.
Figure 2:
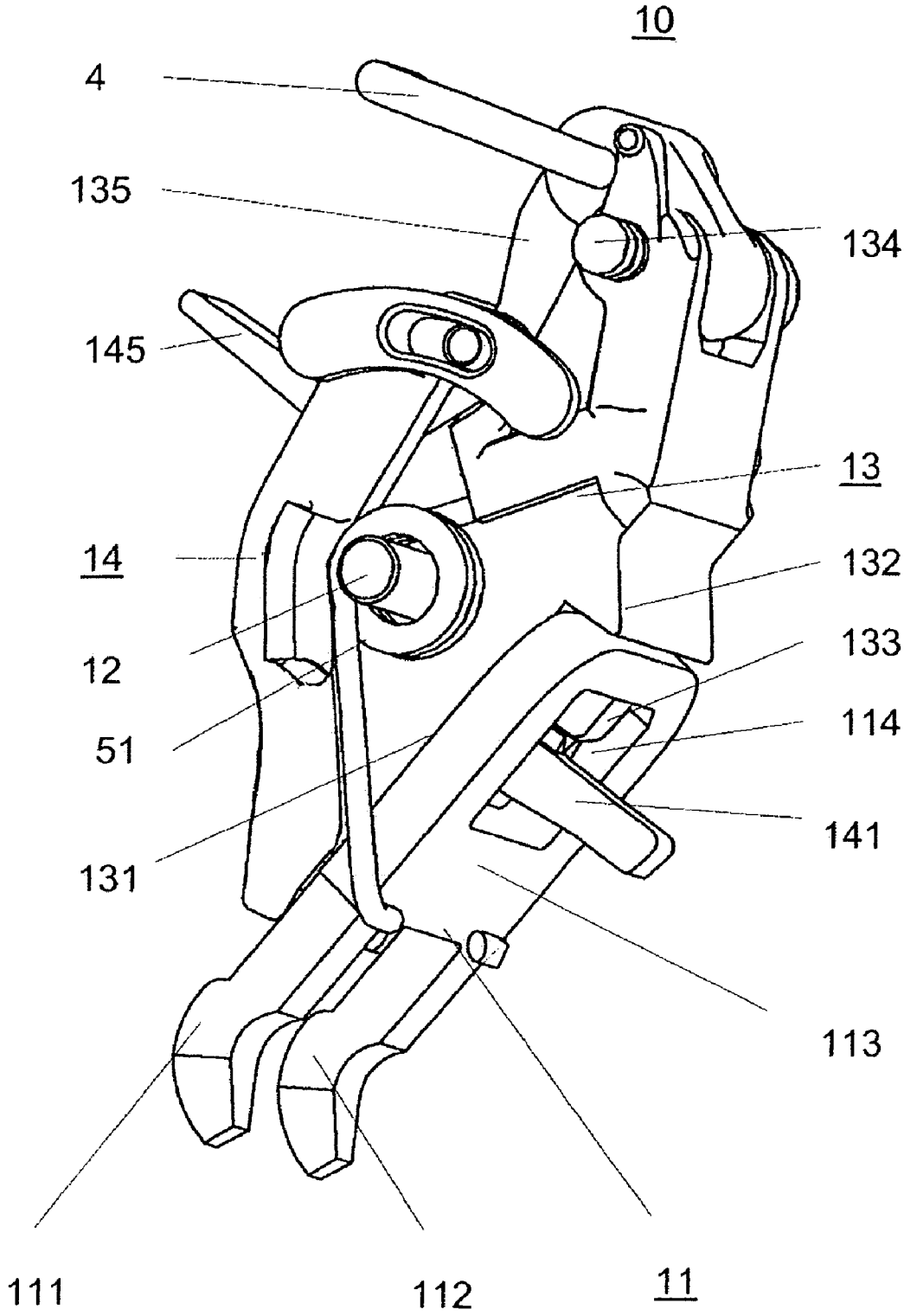
FIG. 2 shows a perspective view of the contact unit shown in FIG. 1, with the circuit breaker in the disconnected state, in which a latching lever of the contact unit and a transmission bracket which is articulated on the latching lever to a switching drive that is not illustrated are shown in the contact unit.

In all of the figures, the same reference symbols denote parts having the same effect. FIG. 1 shows a part of a circuit breaker after removal of an enclosure which surrounds the switch. This part of the circuit breaker contains a contact arrangement 1 with two series-connected switching points and two arc quenching devices which are respectively associated with one of the two switching points. Only one of the two switching points can be seen in FIG. 1. This also applies to the two arc quenching devices, of which that which can be seen is annotated with the reference symbol 2. The switching point which can be seen is formed by a moving contact piece 111 and a stationary contact piece 30 in the contact arrangement 1. The arc quenching device 2 contains two arc guide rails 21, 22 and an arc quenching chamber 23, which contains arcing plates. The second switching point (which cannot be seen) and the second arc quenching device (which cannot be seen) are designed in a similar way and are arranged essentially with mirror-image symmetry with respect to a separating wall 24 which is located on the plane of the drawing. The moving contact piece 111 is part of a moving contact unit 10 which can pivot about a shaft 12 which is mounted in the switch enclosure. The rest of the design of the moving contact unit 10 will be explained in the following text with reference to FIGS. 2 to 5.

As can be seen, the contact piece 111 is part of a U-shaped contact link 11. The two limbs of the U are formed by the moving contact piece 111 and the corresponding contact piece 112 of the second switching point, which cannot be seen in FIG. 1. The base of the U is in the form of a plate 113, and has a quadrilateral opening 114. The plate 113 rests on a planar surface 131 of a contact mount 13 that is composed of insulating material. A projection 132 is formed in the contact mount 13, against which the plate 113 strikes with its side that faces away from the two moving contact pieces 111, 112. A tab 133 which is formed in the contact mount 13 projects into the opening 114 in the contact link 11. A finger 141 which is formed in a tripping lever 14 is passed through the opening 114. At its upper end, which is arranged opposite the resting surface 131, the contact mount 13 is fitted with a latching lever 135 which can pivot about a shaft 134 and on which a transmission bracket 4, which interacts with a switching lever system that is not illustrated, is articulated.

As can be seen from FIGS. 3 to 5, the contact mount 13 has two supporting arms 136 and 137, which are arranged parallel and at a distance from one another in the direction of the pivoting shaft 12 (FIG. 5). The pivoting shaft 134 of the catch 135 (FIG. 3) as well as the pivoting shaft 12 (FIG. 5) are mounted in openings (which are not shown) in these supporting arms. As can be seen from FIG. 5, a tab 142 which holds the rotation point of the two-armed tripping lever 14 is arranged in the space between the two supporting arms 136, 137. A groove 143 is incorporated in this tab and is used to hold a spring 144 which produces a torque and resets the tripping lever 14 in the clockwise direction. The tripping lever 14 is fitted with two plug-in parts 146, 147 (FIG. 3) of two connection elements for adjacent poles of the circuit breaker, and with a stop (which cannot be seen) for an end of the catch 135 which is in the form of a hook. A finger 145 (which points to the left) of the tripping lever 14 and the finger 141 (which points to the right) (FIGS. 2 and 4) which is passed through the opening 114 (FIG. 3) and through an opening (which is not shown) in the contact mount 13 can be operated by two releases (which are arranged differently and can be activated thermally) in the circuit breaker. A force can likewise be applied to the release 14 by a circuit breaker release which can be activated magnetically. For this purpose, it has a striking surface 148 (FIG. 4).

During fitting of the moving contact unit 10, the contact mount 13 and the tripping lever 14 which holds the resetting spring 144 in the groove 143 are plugged together in such a way that the pivoting shaft 12 can be passed through these three parts, as shown in FIG. 5. Once the contact link 11 is resting on the resting surface 131 of the contact mount 13, these five components are stressed by means of two bending springs 51 and 52, which can be seen in FIGS. 3 and 5 and are mounted on the pivoting shaft 12, forming a mechanically firm unit. In this case, not only are the individual components such as the contact mount 13, the tripping lever 14, the pivoting shaft 12 and the contact link 11 mechanically firmly connected to one another, but the contact link 11 and, in a corresponding manner the two moving contact pieces 111, 112, as well, are now supported on the stationary contact pieces by a contact force (which is defined by the characteristics of the springs 51 and 52) when the circuit breaker is in the connected state. This can be seen from the switching point that is formed by the contact pieces 111 and 30 in FIG. 1. As can be seen, when in the connected state, the moving contact piece 111 is pressed against the stationary contact piece 30 with a prestress which is sufficiently strong (and, in a corresponding manner, the moving contact piece 112 which cannot be seen is also pressed against a further stationary contact piece) that the contact link 11 which strikes against the projection 132 is pivoted in the counterclockwise direction about the projection 132 and is lifted off the resting surface 131. Suitable design of the bending springs 51, 52 makes it possible to achieve not only the desired contact force but also, at the same time, the capability for contact hysteresis. This makes it possible to compensate for erosion of the contact pieces and material loss associated with this, while maintaining a sufficiently large contact force by readjustment of the moving contact pieces 111 and 112, and/or of the contact link 11, by means of the bending springs 51, 52.

As can be seen from FIG. 3, the bending springs 51 and 52, respectively, have a respective cylindrical helical spring 511 and 521, through which the pivoting shaft 12 passes and which respectively have two limbs 512, 513 and 521, 523, which are rotated in opposite directions with respect to one another. The limbs 513 and 523 are each held in a respective groove 138 and 139, which are formed in the contact mount 13 while, in contrast, holding fingers 515 and 525 are formed in the limbs 512 and 522 and are supported on the contact link 11, or, respectively, on the two moving contact pieces 110 and 112, forming the prestress and the contact force (when the circuit breaker is in the connected state).

When a short-circuit current or overcurrent occurs, a magnetic or thermal release in the circuit breaker is activated, and a tripping element of one of the releases then strikes against one of the two fingers 141 or 145, or against the striking surface 148. The tripping lever 14 is now rotated in the counterclockwise direction against the force of the resetting spring 144, and in the process overcomes a latch which is formed by the tripping lever 14 and the catch 135. The moving contact unit 10, which is subject to the influence of a loaded spring energy store (which is not illustrated), is pivoted in the counterclockwise direction, and the contact arrangement 1 is opened, forming two series-connected switching arcs.

Once the switching arcs have been quenched in the arc quenching device 2, the circuit breaker can be reconnected. In this case, force is transferred from a switching lever system (which is not illustrated) via the transmission bracket 4 that can be seen in FIG. 2 to the catch 135, and to the moving contact unit 10, which is articulated on it and is latched once again. The moving contact unit is moved in the clockwise direction to the connected position as shown in FIG. 1, with the spring energy store being loaded and with the predetermined contact force being formed.

A simplification of the described embodiment of the moving contact unit 10 is achieved by using only one bending spring instead of two bending springs. This bending spring may be one of the two bending springs 51 or 52. The moving contact unit then advantageously has only one moving contact piece 111 or 112. However, in order to make it possible to position the contact links 11 well in addition, a bending spring is provided having two cylindrical helical springs, through each of which the pivoting shaft passes, and having a U-shaped connection section (which couples the two helical springs with a force fit and is supported on the contact mount), and having two limbs which are each connected to one of the two helical springs and are supported on the contact link 11, or on the contact pieces 111, 112, forming the prestress. A spring such as this, which is identified by the reference symbol 53, is shown partially by dashed lines in FIG. 3. As can be seen, this spring includes the two springs 51 and 52, but in addition also has a connection section, which is illustrated by dashed lines and complements the two limbs 512 and 522 to form the U-shaped connection section 531. Alternatively, the spring 53 that is formed from the two springs 51 and 52 can also be produced by connecting the two fingers 515 and 525 to a central section, which is illustrated by dots. The spring 53 then has a U-shaped connection section 532, which couples the two helical springs 511 and 521 with a force fit and is supported on the contact link 11. The two limbs 513 and 523 are then supported in the grooves 138 and 139 in the contact mount 13.

LIST OF REFERENCE SYMBOLS

| | |
|---|---|
| 1 | Contact arrangement |
| 10 | Moving contact unit |
| 11 | Contact link |
| 111, 112 | Moving contact pieces |
| 113 | Plate |
| 114 | Opening |
| 12 | Pivoting shaft |
| 13 | Contact mount |
| 131 | Resting surface |
| 132 | Projection |
| 133 | Tab |
| 134 | Pivoting shaft |
| 135 | Latching lever, catch |
| 136, 137 | Supporting arms |
| 138, 139 | Grooves |
| 14 | Tripping lever |
| 141 | Finger |
| 142 | Tab |
| 143 | Groove |
| 144 | Resetting spring |
| 145 | Finger |
| 146, 147 | Plug-in parts |
| 148 | Striking surface |
| 2 | Arc quenching device |
| 21, 22 | Arc guide rails |
| 23 | Arc quenching chamber |
| 24 | Separating wall |
| 30 | Stationary contact piece |
| 4 | Transmission bracket |
| 51, 52, 53 | Bending springs |
| 511, 521 | Helical springs |
| 512, 513, 522, 523 | Limbs |
| 515, 525 | Holding finger |
| 531, 532 | U-connection sections |

The invention claimed is:

1. A moving contact unit for a contact arrangement in a circuit breaker, comprising:

a pivot shaft provided for being mounted in an enclosure of the circuit breaker;

a contact mount made of insulating material, which is pivotally arranged on the pivot shaft;

a U-shaped contact link, in which two contact pieces form the limbs of the U;

a latch including a catch supported on the contact mount and a tripping lever which is pivotally arranged on the pivot shaft; and at least one prestressed bending spring mounted on the pivot shaft, wherein the base of the U of the U-shaped contact link is in the form of a plate and rests on a surface of the contact mount, and wherein the contact link is supported on the contact mount by the at least one prestressed bending spring.

2. The contact unit as claimed in claim 1, wherein the bending spring has a cylindrical helical spring, through which the pivoting shaft passes and which has two limbs which can rotate in opposite directions with respect to one another and of which a first limb is supported on the contact mount and the second is supported on the contact piece, forming the prestress.

3. The contact unit as claimed in claim 2, wherein a holding finger which clasps the contact piece is formed in the second limb.

4. The contact unit as claimed in claim 3, wherein the first limb is held in a groove which is formed in the contact mount.

5. The contact unit as claimed in claim 1, wherein the bending spring has two cylindrical helical springs, through each of which the pivoting shaft passes, and has a U-shaped connection section which couples the two helical springs with a force fit and is supported on the contact mount, and has two limbs which are respectively connected to in each case one of the two helical springs and are supported on the contact piece, forming the prestress.

6. The contact unit as claimed in claim 1, wherein the bending spring has two cylindrical helical springs, through each of which the pivoting shaft passes, and has a U-shaped connection section which couples the two helical springs with a force fit and is supported on the contact piece, and has two limbs which are respectively connected to in each case one of the two helical springs and are supported on the contact mount, forming the prestress.

7. The contact unit as claimed in claim 1, wherein the plate has an opening into which a tab which is formed in the contact mount projects.

8. The contact unit as claimed in claim 7, wherein a finger which is formed in the tripping lever is passed through the opening.

9. A contact arrangement having the contact unit as claimed in claim 1.

10. A circuit breaker having the contact arrangement as claimed in claim 9.

11. The contact unit as claimed in claim 1, wherein the side of the plate which faces away from the contact pieces, strikes against a projection which is formed in the contact mount.

* * * * *